US009630754B2

(12) United States Patent
Schmidt et al.

(10) Patent No.: US 9,630,754 B2
(45) Date of Patent: Apr. 25, 2017

(54) TAMPER-EVIDENT BEVERAGE CONTAINER CLOSURE DEVICE

(71) Applicants: David M. Schmidt, Bay City, MI (US); Beth R. Dore, Bay City, MI (US)

(72) Inventors: David M. Schmidt, Bay City, MI (US); Beth R. Dore, Bay City, MI (US)

( * ) Notice: Subject to any disclaimer, the term of this patent is extended or adjusted under 35 U.S.C. 154(b) by 144 days.

(21) Appl. No.: 14/250,372

(22) Filed: Apr. 10, 2014

(65) Prior Publication Data

US 2014/0305940 A1 Oct. 16, 2014

Related U.S. Application Data

(60) Provisional application No. 61/810,374, filed on Apr. 10, 2013.

(51) Int. Cl.
*B65D 50/00* (2006.01)

(52) U.S. Cl.
CPC ..... *B65D 50/00* (2013.01); *B65D 2101/00* (2013.01)

(58) Field of Classification Search
CPC . B65D 51/248; B65D 55/028; B65D 2101/00
USPC ..... 116/202; 206/459.1; 215/201, 203; 220/703
See application file for complete search history.

(56) References Cited

U.S. PATENT DOCUMENTS

2002/0000908 A1* 1/2002 Burg et al. ..... 340/328
2009/0175029 A1* 7/2009 Chiang ..... B65D 51/248 362/101

* cited by examiner

*Primary Examiner* — Laura Martin
*Assistant Examiner* — Irving A Campbell
(74) *Attorney, Agent, or Firm* — L.C. Begin & Associates, PLLC

(57) ABSTRACT

A tamper-evident container closure device is provided. The device is securable to an open container to close the container. The closure device includes an electrically powered tamper-indicating means for indicating that the housing has been detached from the container after being secured to the container.

4 Claims, 5 Drawing Sheets

TAMPER-EVIDENT BEVERAGE CONTAINER CLOSURE DEVICE

CROSS-REFERENCE TO RELATED APPLICATIONS

This application claims the benefit of U.S. Provisional Application Ser. No. 61/810,374, filed on Apr. 10, 2013, the disclosure of which is incorporated herein by reference in its entirety.

BACKGROUND OF THE INVENTION

This disclosure relates to beverage container lids and enclosures, and more particularly to security devices and methods for notifying a user of unauthorized access to the contents of the beverage container.

BACKGROUND

The statements in this section merely provide background information related to the present disclosure and may not constitute prior art.

It is known that drugs or other harmful substances are occasionally unscrupulously added to drinks without the knowledge of the persons consuming the drinks (i.e., the "spiking" of drinks). Some of these substances, including, gamma-hydroxybutyric acid (also known as "GHB") and Rohypnol (also known as "roofies"), known as "date rape" drugs, have been added to the drinks of women in public bars to inhibit their faculties and reduce the woman's ability to ward off sexual advances. In additional to date rape drugs, there are other problems associated with unauthorized introduction of substances introduced into drinks, including deliberate attempts to cause the person harm or mischievous pranks.

Various devices have been marketed to protect the contents of a container. Many of these devices are designed to protect against unintended spillage of the container's contents rather than protecting against introduction of foreign substances into the container. Known devices do not provide notification to a user that the contents of a container have been manipulated or otherwise accessed after opening of the container, without user permission or knowledge.

Accordingly, a need exists for a beverage container to inhibit access to beverage contents after opening of the container and provide notice when beverage contents are exposed to unauthorized access when left unattended.

SUMMARY OF THE INVENTION

In one aspect of the embodiments described herein, a tamper-evident container closure device is provided, the device includes a housing structured to receive of a portion of a container therein, a first electrical contact element coupled to the housing, and a second electrical contact element coupled to the housing. Each of the first and second contacts has at least one exposed conductive surface portion. At least one of the first and second contacts has at least one insulated surface portion. The first contact has an end portion positioned along a first side of the second contact prior to insertion of the container portion into the housing. The end portion is structured to move from the first side of the second contact to a second side of the second contact opposite the first side responsive to an insertion of the container portion into the housing. The end portion is structured to touch the second contact during movement of the end from the first side to the second side. The end portion is structured so that only the at least one insulated surface portion of the at least one of the first and second contacts touches the other one of the first and second contacts when the first and second contact touch during movement of the end portion from the first side to the second side.

In another aspect of the embodiments described herein, a tamper-evident container closure device is provided. The device is securable to an open container to close the container. The closure device includes an electrically powered tamper-indicating means for indicating that the housing has been detached from the container after being secured to the container

DETAILED DESCRIPTION

Figure 1:
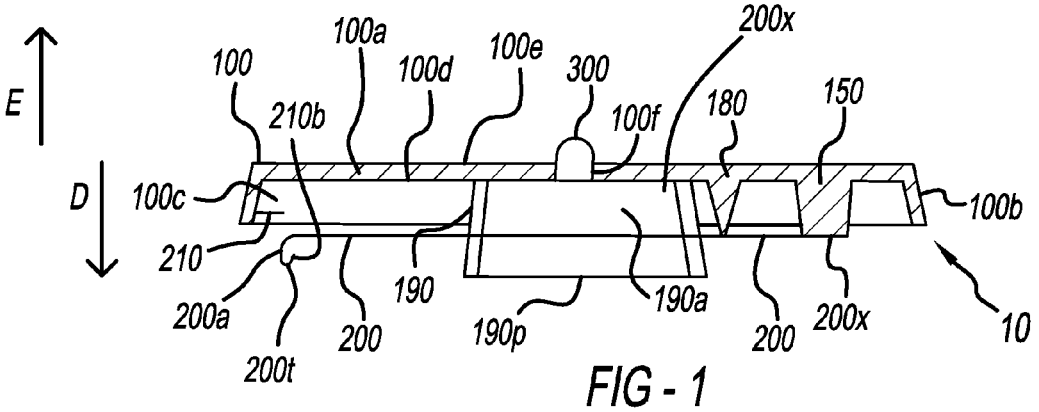
FIG. 1 is a cross-sectional side view of one embodiment of a tamper-evident beverage closure device.

In the various embodiments described herein, like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. As used herein, the term "or" is an inclusive "or" operator, and is equivalent to the term "and/or," unless the context clearly dictates otherwise. The term "based upon" is not exclusive and allows for being based on additional factors not described, unless the context clearly dictates otherwise.

A tamper-evident beverage closure device is disclosed. The closure device includes an electrical circuit having a tamper indicator such as a lighting device or alarm, and an enclosure for covering a beverage container or bottle and housing the electrical circuit. The closure device further includes an electrical conducting lead configured to electrically complete the electrical circuit upon disengagement of a beverage container or bottle from the closure device. By completing the electrical circuit, the tamper indicator may be electrically actuated indicating to a device user that the closure device was disengaged from the beverage container or bottle.

Certain embodiments of the invention are configured for one-time-use. A trigger switch is configured to preferentially deform by engagement and subsequent disengagement of a beverage container or bottle. Disengagement completes the electrical circuit and electrically powers the tamper indicator. Preferential deformation of the trigger switch inhibits unscrupulous actors from unknowingly tampering with a beverage container engaged with the closure device as the deformed trigger switch is not configured to selectively reset.

Referring now to the drawings, wherein the depictions are for the purpose of illustrating certain exemplary embodiments only and not for the purpose of limiting the same, closure device 10 has a housing 100 including a base portion 100*a* and an outer wall 100*b* extending in a direction "D" from a periphery of the base portion. In the embodiment shown in FIGS. 1-2, outer wall 100*b* is circular. However, the outer wall 100*b* may have any alternative shape suitable for the needs of a particular application. In combination, base portion 100*a* and wall 100*b* define an outer cavity 100*c* therebetween.

Base portion has an inner surface 100*d* and an outer surface 100*e* opposite the inner surface. Inner surface 100*d* defines a floor of the outer cavity 100*c*. In one embodiment, base portion has an opening 100*f* formed therealong for mounting of a tamper indicating means (generally designated 300) therein.

An inner wall 190 extends from inner surface 100*d* in the general direction of arrow "D" to define an inner cavity 190*a* structured for receiving therein a top portion 900*a* of a beverage bottle 900 (for example, a soda or beer bottle). Inner cavity 190*a* and wall 190 are thus surrounded by outer cavity 100*c* and outer wall 100*b*. In the embodiment shown in FIGS. 1-2, interior surfaces 190*x* of wall 190 are tapered such that inner cavity narrows in direction 'E" proceeding from an opening 190*p* of the inner cavity toward housing base portion 100*a*. Opening 190*p* may be sized to a diameter substantially larger than the top of the bottle, so as to aid in capturing the bottle and directing the bottle into the inner cavity 190*a*.

Referring again to FIG. 2, a pair of opposed slots 190*g* and 190*h* are formed in wall 190. Slots 190*g* and 190*h* are aligned and structured for receiving therein portions of an elastically deformable electrical contact element 200 (described in greater detail below). Slots 190*g* and 190*h* are structured to permit contact element to move freely therein. In one embodiment, slots 190*g* and 190*h* extend from the end of inner wall 190 to housing base portion 100*a*.

Figure 2:
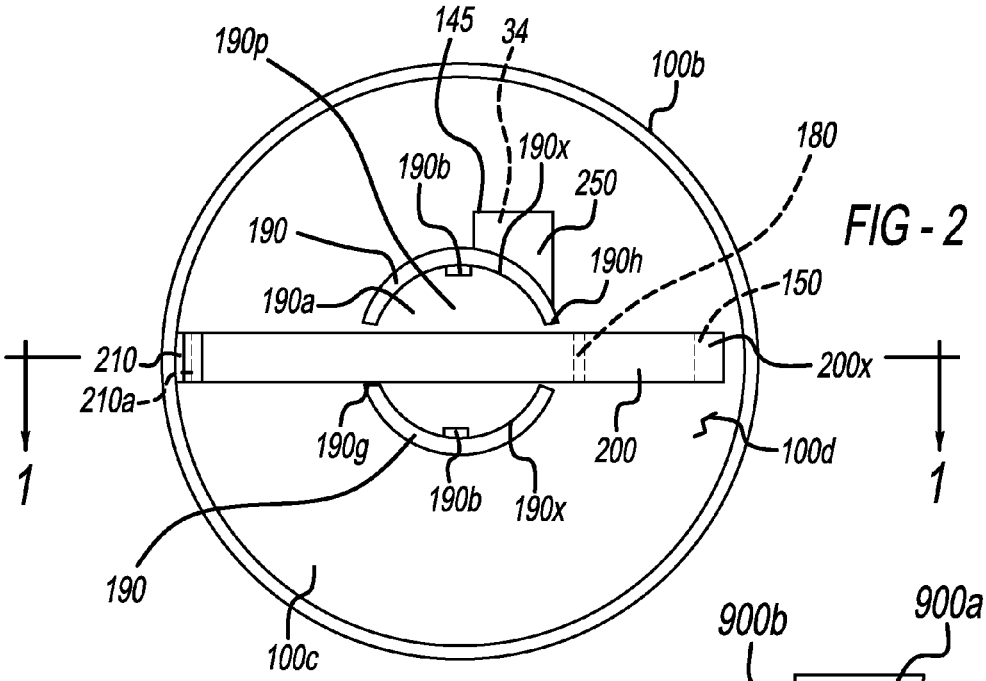
FIG. 2 is an underside view of the closure device embodiment shown in FIG. 1.
Figure 2A:
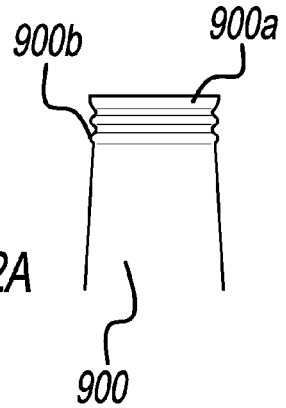
FIG. 2A is a side view of a portion of a beverage bottle which the closure device embodiment shown in FIG. 1 is configured to receive therein.

In the embodiment shown, a plurality of tabs 190*b* extend inwardly from interior surfaces of wall 190. Tabs 190*b* are located along wall 190 with respect to inner surface 100*d* so as to slidingly engage and grip associated ridges 900*b* formed along the beverage bottle neck near the opening of the bottle (as shown in FIG. 2A). This engagement aids in retaining the closure device on the bottle. In the positions described, tabs 190*b* may also serve as stops limiting an insertion depth of the bottle into the inner cavity. Alternatively, other tabs or features (not shown) may be formed along inner surface 100*d* or along inner wall 190 to serve as hard stops limiting the insertion depth of the bottle into the inner cavity. Due to the provision of slots 190*g* and 190*h* in wall 190, the portions of the wall 190 on either side of the slots may resiliently or elastically deflect responsive to insertion of the bottle into inner cavity and engagement between the tabs 190*b* and the bottle neck.

Referring to FIGS. 10-13, in an optional alternative embodiment, a plurality of opposed rubber gripping members are secured to inner surfaces of inner wall 190 between slots 190*g* and 190*h* to aid (in conjunction with tabs 190*b*) in securing the bottle neck within the cavity defined by the inner wall 190.

A first contact end support 150 extends from inner surface 100*d*. An end 200*x* or other portion of contact element 200 is secured to the end support 150, thereby securing this portion of the contact to the housing 100. The contact element 200 may be secured to the end support using molding, ultrasonic welding, or any other suitable means.

A fulcrum 180 extends from inner surface 100*d* to provide a pivot bearing surface for electrical contact element 200, in the manner described below. In one embodiment, fulcrum 180 is formed integrally with base portion 100*a*. In other embodiments, the fulcrum may be formed separately from the base portion and attached to inner surface 100*d* or another portion of housing 100 using adhesives, ultrasonic welding, or any other suitable method. Whether formed integrally with or separately from housing 100, the fulcrum may be designed so as to be adjustably positionable (for example, using movable tooling inserts) between end support 150 and inner wall 190 along axis of contact element 200. This enables the fulcrum position to be adjusted so as to aid in achieving optimum force-deflection characteristics in the contact element 200 for a given application.

One or more additional wall(s) 145 (FIG. 2) may extend from housing base portion 100*a* and/or from another portion of the housing so as to define a battery compartment 250 structured to receive and retain therein a battery or other power source 34 suitable for powering the tamper indicating means 300. Wall(s) 145 may be positioned at any suitable location with the outer cavity 100*c*. Alternatively, the battery compartment may be provided as a cavity or recess formed in housing base portion 100*a* or wall 100*b*. Conductive circuit elements (not shown) positioned within the battery compartment 250 are configured for electrically engaging the battery to power the tamper indicating means circuit.

Contact element 200 extends from end support 150, passes over or contacts fulcrum 180, then extends through inner wall slots 190*g* and 190*h* toward a side of outer wall 100*b* residing diametrically opposite the end support 150. As used herein, the term "elastically deformable" means that the contact element (or the structure to which it is attached) may be deflected from an initial or undeflected state by application of a force to the contact element or attachment structure, after which the contact element will attempt to return to its initial or undeflected state after removal of the applied force (i.e., there will be enough elasticity in the contact element after deflection to return the element to a non-deflected state or a substantially non-deflected state).

Contact element 200 is electrically coupled to the remainder of an electrical circuit 500 (shown schematically in FIG. 3) designed to power a tamper indicating means (described below) in the event that the circuit is closed by removal of the closure device from a bottle after insertion of the bottle into the inner cavity 190*a* of the device. Contact element 200 may be formed from any suitable material, for example, a copper alloy. Alternatively, the contact element 200 may be formed from an elastically deformable base member (not shown) with a conductive strip or element (not shown) bonded or otherwise suitably attached to a surface thereof.

Another contact element 210 extends from outer wall 100*b* in a direction toward end 200*a* of contact element 200. At least an end portion 210*a* of contact element 210 may be elastically deformable. Contact element 210 is also electrically coupled to the remainder of the electrical circuit 500 (shown schematically in FIG. 3). Contact element 210 may be formed from any suitable material, for example, a copper alloy or other conductive material projecting from wall 100*b*. Alternatively, the contact element 210 may be formed from an elastically deformable base member 210*y* (for example, a member extending from and formed integrally with wall 100*b*) with a conductive strip or element (not shown) bonded or otherwise suitably attached to a surface of the base member.

An exposed, electrically conductive surface portion of the contact element 200 is positionable so as to establish electrical contact with a complementary exposed electrically conductive portion of contact element 210 after removal of the bottle from inner cavity 190*a*, thereby completing the electrical circuit needed to power the tamper indicating means as described below. In addition, a exposed conductive surface of the contact element 210 will be positioned so as to establish electrical contact with a complementary exposed conductive surface portion of contact element 200 after removal of the bottle from inner cavity 190*a*, thereby completing the electrical circuit needed to power the tamper indicating means as described below. In the embodiment shown, the exposed conductive surface portion of the contact element 210 is located along an upper surface 210*b* of end portion 210*a*, while an edge 210*g* of the end portion, opposite sides 210*s* and 210*r* of the end portion, and a lower surface 210*d* and opposite the upper surface is covered with an electrically insulating material, for example, a polymeric, rubberized or other type of insulating layer. Also, the exposed electrically conductive portion of the contact element 200 is located along a lowermost portion 200*t* of the end of the contact that can only come into contact with upper surface 210*b* after passing contact 210 during insertion of a bottle into cavity 190*a*, as described herein. The remainder of the surfaces of contact 200 which touch contact 210 during deflection of contact 200 are covered with an electrically insulating material, for example, a polymeric, rubberized or other type of insulating layer. Thus, when contact element 200 and 210 touch anywhere except along regions 200*t* and 210*b*, the electrical circuit will not be completed. Thus, in the embodiment shown, the exposed conductive surface of contact 200 resides along the lowest portion of contact end 200*a*, while the exposed conductive surface of contact 210 resides along the uppermost surface of the contact.

Figure 3:
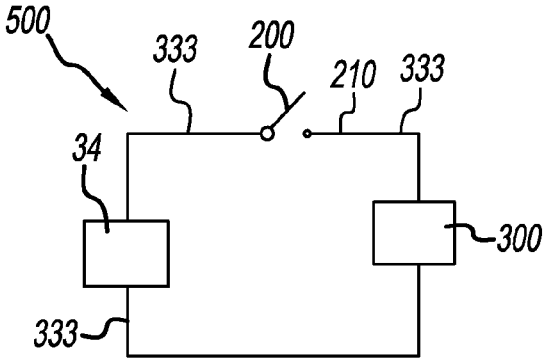
FIG. 3 is a schematic view of an electric circuit of the closure device, in accordance with an embodiment described herein.
Figure 4:
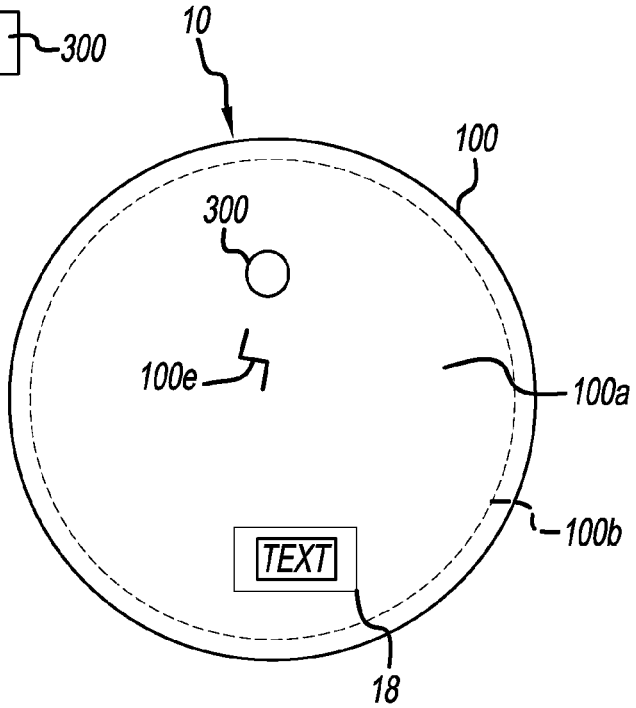
FIG. 4 is a plan or top view of the closure device embodiment shown in FIG. 1.

FIG. 3 schematically shows the exemplary electrical circuit 500 of the closure device 10. As FIG. 3 shows, the electrical circuit 500 includes the battery 34, the tamper indicating means 300, the contacts 200 and 210, and the conductive elements connecting the contacts 200 and 210, the battery, and the tamper indicating means 300. In further embodiments, multiple additional leads and circuit elements may be included as the closure device 10 is adapted for various beverage containers and bottles. As one skilled in the art will readily recognize, the contacts 200 and 210, when engaged, function as a switching device although it will be appreciated that the disengagement of the beverage container or bottle will render the switch structure inoperable for multiple use or, at least, degrade the switching structure from further use as tamper-evident device.

The various conductive circuit elements (generally designated 333)(not shown) connecting the contacts 200 and 210, the battery, and the tamper indicating means 300 may extend along any surface of (or within any of) housing base portion 100*a*, housing wall 100*b*, fulcrum 150, end support 150 and/or inner wall 190, according to the force deflection, electrical and spatial requirements of a particular application. The conductors forming the circuit may be wires, flat conductive traces attached to or molded into portions of housing 100 (for example, onto base portion inner surface 100*d*), or any other conductors suitable for carrying sufficient current to activate whatever tamper indicating means is incorporated into the closure. The conductors or portions of the conductors may be formed integrally with each other or separately, and may be formed from copper alloys or any other suitably conductive materials. Connections between separate conductors of the circuit and between the contacts 200 and 210 and the other circuit elements may be formed by soldering, resistance welding, or any other suitable means.

Tamper indicating means 300 may comprise a visible indicator such as a light source (for example, an LED), an audible indicator (such as an audible alarm or beeper) or any other suitable indicating means.

The battery or power source use to power the electrical circuits described herein may be a known wristwatch battery or other suitably structured power source positionable in a battery compartment configured in housing 100.

Figure 5:
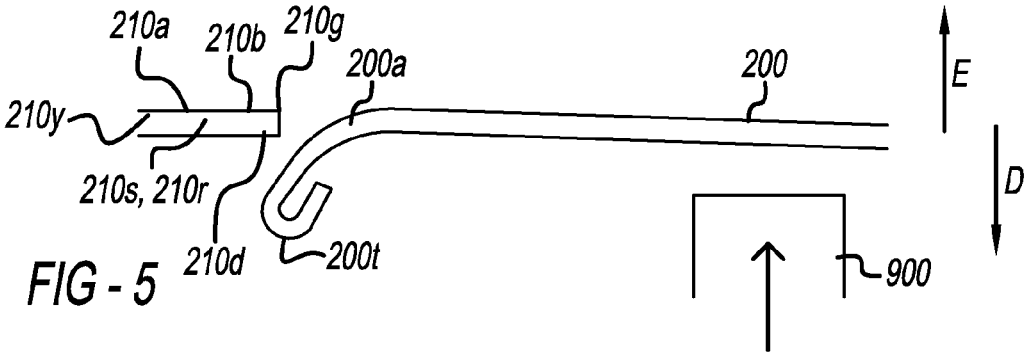
FIG. 5 is a side-view of a portion of the closure device embodiment shown in FIG. 1 prior to insertion of the top of a bottle into the closure device.

FIGS. 5-8 show the progression of deflection of contact 200 during insertion of bottle 900 into cavity 190*a*. Referring to FIGS. 1, 2, and 5, prior to insertion of bottle 900 into inner cavity 190*a*, contact element 200 is structured to reside on a side of contact element 210 opposite from the side on which housing base portion resides. That is, contact element 210 resides between contact element end portion 200*a* and housing base portion 100*a*. FIGS. 5-8 show one embodiment of a contact end geometry for contact end portion 200*a*. However, any other suitable contact geometry may be used.

In the embodiments described herein, contact element 200 is elastically deformable in direction "E" responsive to application of the force in direction "E" by a bottle being inserted into inner cavity 190*a*. In a particular embodiment, contact element end portion 200*a* is structured so as to be elastically deformable responsive to contact with contact element 210, during movement of the end portion 200*a* in direction "E". In the embodiments described herein, contact element 200 is also structured so as to spring back in direction "D" upon removal of the bottle from inner cavity 190*a*, such that the electrically conductive portion of element end 200*a* contacts the electrically conductive portion of contact element 210 after removal of the bottle.

FIGS. 1, 2 and 5 show one embodiment of the configuration of contacts 200 and 210 prior to insertion of a bottle 900 into inner cavity 190*a* (not shown).

Figure 6:
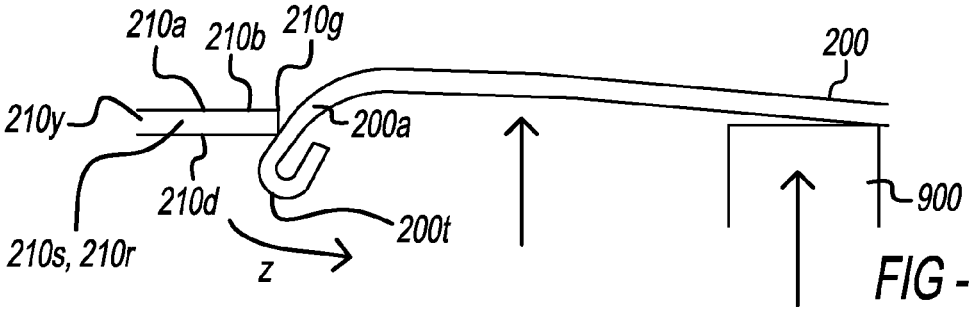
FIG. 6 is the side-view of FIG. 5 showing initial deflection of a contact element of the closure device responsive to insertion of a bottle into the closure device.

Referring to FIGS. 1, 2 and 6, upon insertion of the bottle 900 into inner cavity 190*a*, the bottle end engages contact element 200, forcing the contact end 200*a* in direction "E" and forcing contact element portions 200*a* and 210*a* to engage each other. Contact portion 200*a* may deflect as indicated by arrow "Z" as it brushes against contact 210. At this stage of bottle insertion, however, the insulator-covered surface portions of contact 200 are touching the insulator-covered surface portion 210*d* and/or 210*g* of contact 210. Thus, the tamper indicator electrical activation circuit is not complete.

Figure 7:
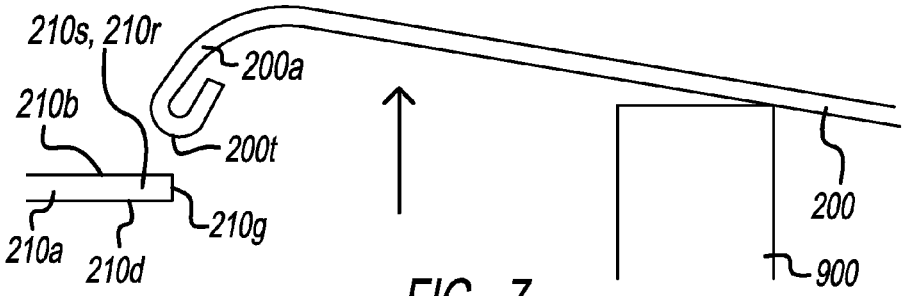
FIG. 7 is the side-view of FIG. 6 showing a contact element configuration of the closure device after sliding of the contact elements past each other, responsive to insertion of the bottle further into the closure device.

Referring to FIGS. 1, 2 and 7, as motion of contact element end portion 200*a* continues in direction "E", the ends 200*a* and 210*a* of the contact elements slide along each other and are forced past each other as one or more of the contacts elastically deflect in response to the force applied by the bottle to contact element 200. Contact element end portion 200*a* now resides between contact element portion 210*a* and housing base portion 100*a*, as shown in FIG. 7. Contact element 200 continues to deflect in direction "E" until the bottle neck ridges 900*b* are engaged and gripped by tabs 190*b*. At this point, contact portion 200*a* is spaced apart from contact portion 210*a*. However, because contact portion 200*a* is now positioned between contact portion 210*a* and housing base portion 100*a*, the exposed conductive surface portion 200*t* of contact 200 now resides directly opposite and spaced apart from the exposed conductive surface portion 210*b* of contact element 210.

Figure 8:
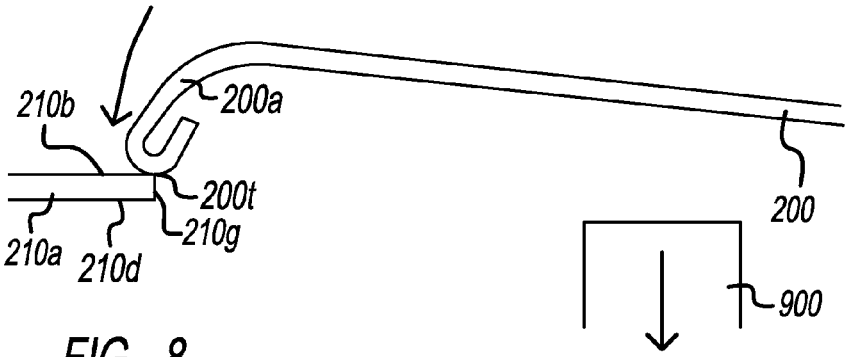
FIG. 8 is the side-view of FIG. 7 showing a contact element configuration of the closure device after the bottle is no longer in contact with the contact element, and conductive portions of the contact elements are in contact with each other to close complete an electrical circuit of the closure device.

Referring to FIGS. 1, 2 and 8, if the bottle 900 is withdrawn (in direction "D") from inner cavity 190*a*, the force holding contact portion 200*a* in a position spaced apart from contact portion 210*a* is removed. This permits the elastically deformable contact element 200 to spring back in direction "D" until the exposed conductive contact portion 200*t* makes contact with exposed conductive contact portion 210*b*. This completes the electrical circuit powering the tamper indicating means.

Referring to FIGS. 9-13, another embodiment 1010 of the closure device is substantially similar to the embodiment shown in FIGS. 1-8. However, in this embodiment, an additional elastically deformable contact element 910 is operatively coupled to inner wall 190 proximate one of slots 190*g* and 190*h*. Contact 910 is positioned so as to be engageable by contact element 200 during deflection of contact 200 when the contact is forced further into cavity 190*a* by insertion of the bottle. Contact element 910 is also electrically coupled to the remainder of the electrical circuit 501 (shown schematically in FIG. 14). Contact element 910 may be formed from any suitable material, for example, a copper alloy or other conductive, elastically deformable material projecting from inner wall 190. Alternatively, the contact element 910 may be formed from an elastically deformable base member 910*y* (for example, a member extending from and formed integrally with inner wall 190) with a conductive strip or element (not shown) bonded or otherwise suitably attached to a surface of the base member.

An exposed, electrically conductive surface portion 200*h* of the contact element 200 is positionable so as to establish electrical contact with a complementary exposed electrically conductive portion 910*z* of contact element 910 after removal of the bottle from inner cavity 190*a*, thereby completing the electrical circuit needed to power the tamper indicating means as described herein. In addition, a exposed conductive surface 910*z* of the contact element 910 will be positioned so as to establish electrical contact with a complementary exposed conductive surface portion 200*h* of contact element 200 after removal of the bottle from inner cavity 190*a*, thereby completing the electrical circuit needed to power the tamper indicating means as described below. In the embodiment shown, the exposed conductive surface portion 910*z* of the contact element 910 is located along an upper surface of the contact, while an edge 910*g* of the end portion, opposite sides 910*s* and 910*r* of the end portion, and a lower surface 910*d* and opposite the upper surface is covered with an electrically insulating material, for example, a polymeric, rubberized or other type of insulating layer. Also, the exposed electrically conductive portion 200*h* of the contact element 200 is located along a portion of the contact that can only come into contact with exposed surface 910*z* after passing contact 910 during insertion of a bottle into cavity 190*a*, as described herein. The remainder of the surfaces of contact 200 which touch contact 910 during deflection of contact 200 are covered with an electrically insulating material, for example, a polymeric, rubberized or other type of insulating layer. Thus, when contact element 200 and 910 touch anywhere except along regions 200*h* and 910*z*, the electrical circuit will not be completed. Therefore, in the embodiment shown, the exposed conductive surface 200*h* of contact 200 resides along the lowest portion of contact 200*a* proximate contact 910, while the exposed conductive surface 910*z* of contact 910 resides along the uppermost surface of the contact.

Figure 15A:
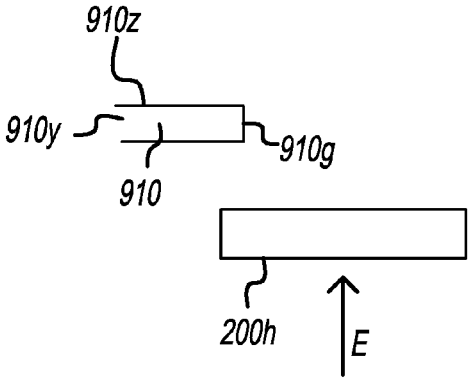
FIGS. 15A-15D show a progressive deflection of a first contact as a bottle is inserted into the housing and exerts a force on another contact, in accordance with another embodiment described herein.
Figure 15B:
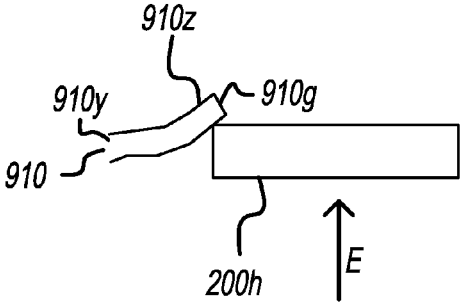
Figure 15C:
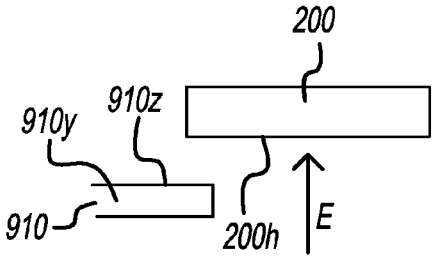
Figure 15D:
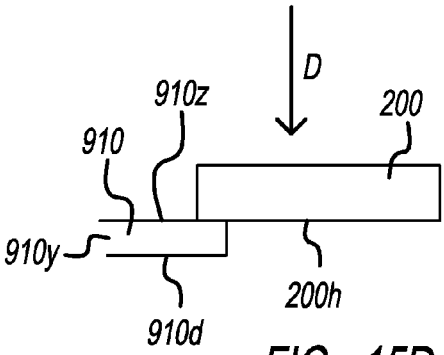

FIGS. 15A-15D show progressive deflection of contact 200 as a bottle is inserted into cavity 190*a* and exerts a force on the contact 910. FIG. 15A shows contact 200*a* moving in direction E prior to touching contact 910. FIG. 15B shows the contacts after touching, wherein contact 200 exerts a force on the end of contact 910 causing contact 910 to resiliently deflect or elastically deform. A portion of contact 200 may also deform responsive to engagement between the contacts. FIG. 15C shows the contacts after contact 200 has passed contact 910, after deeper insertion of contact 200 into cavity 190*a*. FIG. 15D shows the contacts after removal of the bottle from cavity 190*a*. In this configuration, the exposed conductive portions of the contacts are touching, thereby completing the electrical circuit powering the tamper-indicating means 300.

Figure 9:
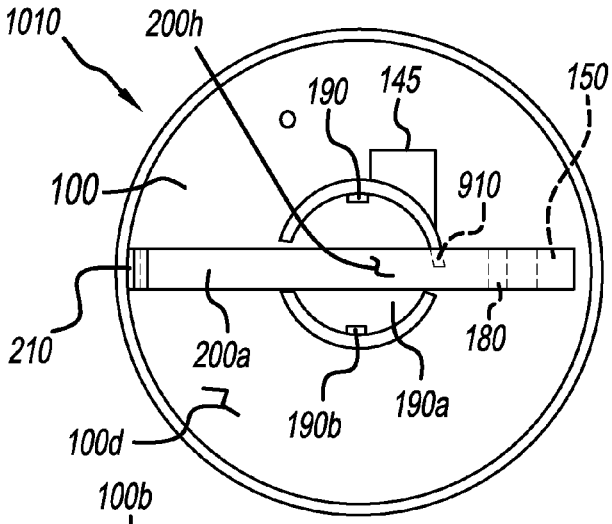
FIG. 9 shows a view of an underside of another embodiment of a closure device prior to insertion of a bottle therein.

FIG. 9 shows a view of an underside of closure device 1010 prior to insertion of a bottle therein. Contact element 910 is electrically coupled to battery 34, tamper indicating means 300, and contact element 200 by conductive circuit elements (wires, conductive traces, etc.) as previously described, such that electrical contact between conductive portions of contacts 200 and 910 closes an electrical circuit powering the tamper indicating means 300.

Figure 10:
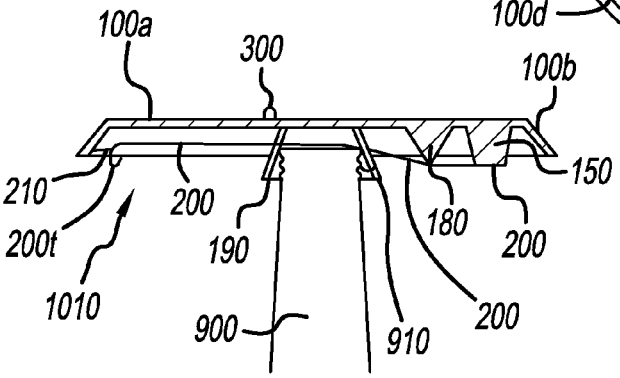
FIG. 10 is a side view of the embodiment shown in FIG. 9.
Figure 11:
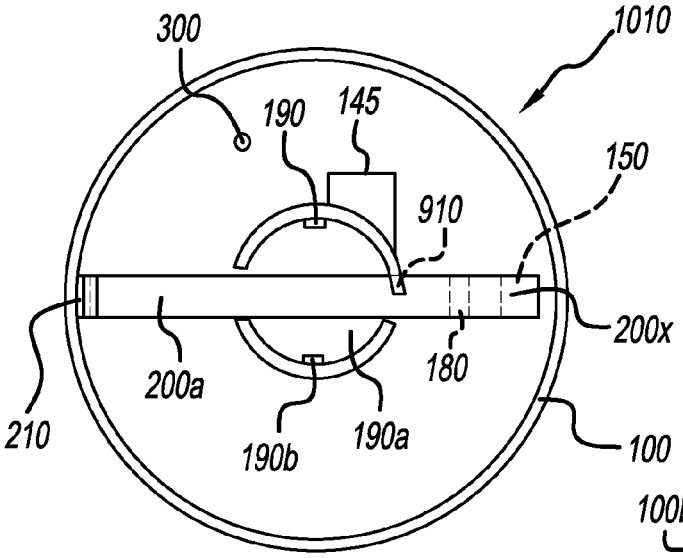
FIG. 11 shows the underside view of FIG. 9 with a deflected electrical contact element after insertion of a bottle therein.

Referring to FIG. 10, contact element 910 is positioned and structured so as to engage contact element 910 and elastically deflect contact 910 as insertion of the bottle 900 pushes contact 200 deeper into cavity 190*a*. As contact 200 is inserted deeper into cavity 190*a*, contact 200 passes and loses contact with contact 910, in a manner similar to that previously described with regard to FIGS. 5-8. The contacts 200 and 910 are also covered with an insulating material or otherwise insulated along selected portions thereof so that, during this engagement between the contacts and deflection of contact 910, at least one layer of insulative material separates the contacts, thereby preventing closure of the electrical circuit while contact 200 is brushing against contact 910 during bottle insertion.

Contact element 910 is structured to snap back into a non-deflected or substantially non-deflected state after contact 200 has passed contact 910. Then, while the bottle 900 remains inserted into cavity 190*a*, contact 200 remains spaced apart from contact 910, in the deflected state shown in FIG. 11 due to force exerted by the bottle. For clarity, the bottle 900 is not shown in FIG. 11. The contacts 200 and 910 are also structured to provide exposed electrically conductive surfaces positioned to touch each other when contact 200 springs back after removal of the bottle from cavity 190*b*.

Figure 12:
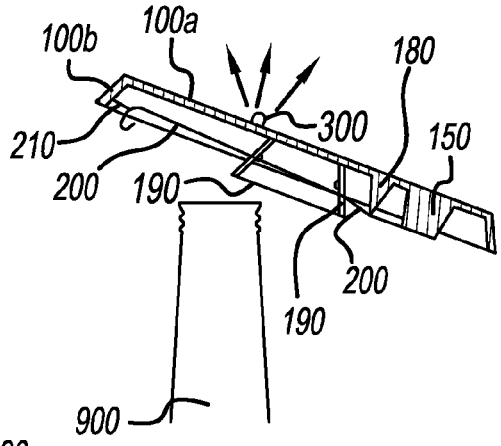
FIG. 12 is a side view of the embodiment shown in FIGS. 9-11 after removal of a bottle from the closure device.
Figure 12A:
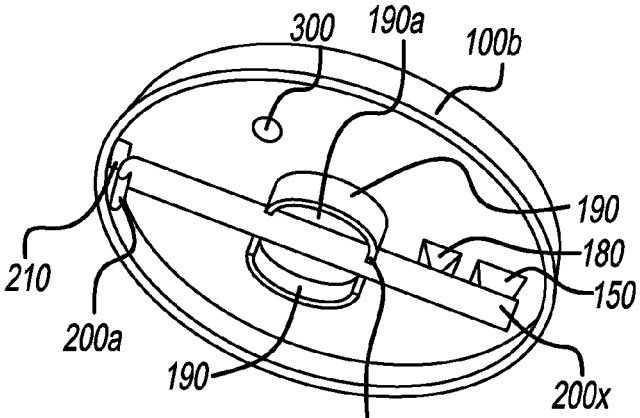
FIG. 12A is a perspective view of the embodiment shown in FIGS. 9-12 after removal of a bottle from the closure device.
Figure 13:
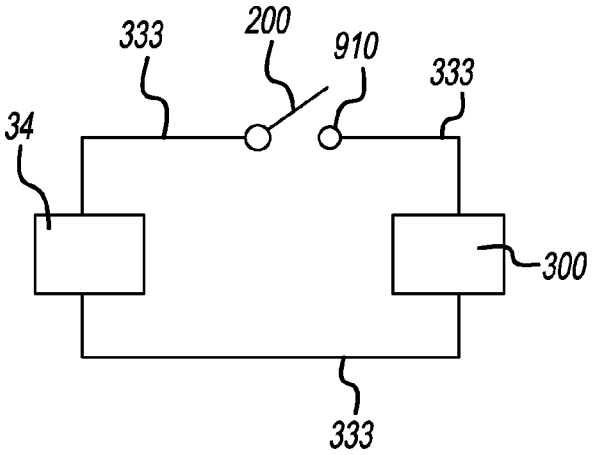
FIG. 13 is a schematic view of an electric circuit of the closure device shown in FIGS. 9-12.
Figure 14:
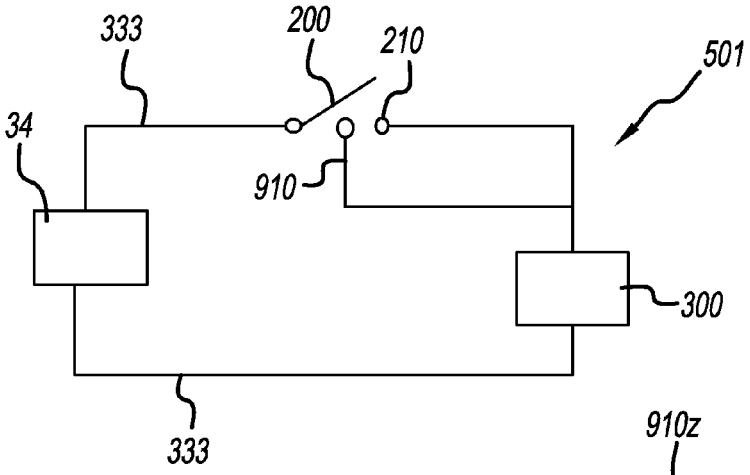
FIG. 14 is a schematic view of an electric circuit of another embodiment of the closure device.

Referring to FIG. 12, upon withdrawal of the bottle from cavity 190*b*, the elastically deformable contact 200 tends to return to its undeflected state. Contact 200 thus springs back away from housing base portion 100*a* and an exposed conductive surface of the contact engages an exposed conductive surface of contact element 910, thereby closing the electrical circuit activating the tamper indicating means 300. In this embodiment, end 200*a* of contact 200 does not slide past contact 210. Thus, contact end 200*a* does not electrically engage contact end 210*a* as previously described. An electrical circuit 501 for this embodiment is shown in FIG. 14.

In another embodiment, the closure device is structured so that contact 200 also engages contact 210 during deflection of contact 200, as previously described. Thus, when contact 200 is released by withdrawal of the bottle 900 from cavity 190*b*, the exposed electrically conductive surfaces of contact 200 and contact 210 also touch to complete the electrical circuit. Therefore, this embodiment provides redundant electrical contact activating the tamper-indicating means. That is, if one of the designed contact interfaces (between contacts 200 and 210 and between contacts 200 and 910) fail for some reason, the remaining contact interface should still activate to close the electrical circuit. An electrical circuit for this embodiment is shown in FIG. 15.

Referring again to FIG. 4, in particular embodiments of the closure device, an indicia (generally designated 18) may be positioned on an exterior surface (for example, outer surface 100*e* of housing 100) for displaying, for example, a tradename or promotional message. The indicia may further serve to project an aesthetic purpose or functionality of the closure device, concealing or distracting from the intended purpose of inhibiting beverage tampering.

In one example, one or more rings or pads of a "peel-and-stick" adhesive material are positioned along an underside of the housing. This adhesive material allows the device, once the tamper-indicating means 300 has been activated, to be utilized as a large "button" that can be attached to clothing as a type of lighted decoration, on a wall as an advertisement, or on objects (for example, chairs) to identify the presence or "ownership" of a person in possession of the closure device. An illuminated beverage closure device might also serve as a type of conversation piece to use as an introduction to others or as a part of a game to identify a winner in a type of lottery (where the message isn't known until the device is activated) or as a clue that might lead towards solving some riddle or mystery.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

What is claimed is:

1. A tamper-evident container closure device comprising:

a housing structured to receive of a portion of a container therein;

a first electrical contact element coupled to the housing;

a second electrical contact element coupled to the housing, each of the first and second contacts having at least one exposed conductive surface portion, at least one of the first and second contacts having at least one insulated surface portion, the first contact having an end portion positioned along a first side of the second contact prior to insertion of the container portion into the housing, the end portion being structured to move from the first side of the second contact to a second side of the second contact opposite the first side responsive to an insertion of the container portion into the housing, the end portion being structured to touch the second contact during movement of the end portion from the first side to the second side, the end portion being structured so that only the at least one insulated surface portion of the at least one of the first and second contacts touches the other one of the first and second contacts when the first and second contact touch during movement of the end portion from the first side to the second side.

2. The closure device of claim 1 wherein the housing is securable to the container over an opening of the container when the container portion is inserted into the housing, to prevent access to an interior of the container, and wherein the first contact end portion is structured so as to be spaced apart from the second contact when the housing is secured to the container.

3. The closure device of claim 2 wherein the first and second contacts are structured such that the at least one exposed conductive surface portion of the first contact moves into contact with the at least one exposed conductive surface portion of the second contact responsive to removal of the container portion from the housing.

4. The closure device of claim 3 wherein an electrical circuit is positioned in the housing, the electrical circuit including an electrically powered tamper-indicator, wherein the first and second contacts are incorporated into the electrical circuit, and wherein contact between the at least one exposed surface portion of the first contact and the at least one exposed surface portion of the second contact completes the electrical circuit to supply power to the tamper-indicating means.

* * * * *